US006480569B2

(12) United States Patent
Sato

(10) Patent No.: US 6,480,569 B2
(45) Date of Patent: Nov. 12, 2002

(54) X-RAY CONTROL APPARATUS AND X-RAY DIAGNOSTIC APPARATUS

(75) Inventor: Hideki Sato, Nasu-gun (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 132 days.

(21) Appl. No.: 09/739,782

(22) Filed: Dec. 20, 2000

(65) Prior Publication Data

US 2001/0012329 A1 Aug. 9, 2001

(30) Foreign Application Priority Data

Dec. 21, 1999 (JP) ..... 11-362885

(51) Int. Cl.[7] ..... H05G 1/66
(52) U.S. Cl. ..... 378/93; 378/125; 378/144
(58) Field of Search ..... 378/93, 125, 144, 378/114, 131

(56) References Cited

FOREIGN PATENT DOCUMENTS

JP 07282991 A * 10/1995 ..... H05G/01/66
JP 11233287 A * 8/1999 ..... H05G/01/66

* cited by examiner

*Primary Examiner*—David P. Porta
*Assistant Examiner*—Courtney Thomas
(74) *Attorney, Agent, or Firm*—Oblon, Spivak, McClelland, Maier & Neustadt, P.C.

(57) ABSTRACT

In an X-ray diagnostic apparatus, the rotation anode of an X-ray tube is placed in rotation at a given low speed prior to examination of an object under examination by fluoroscopy. For fluoroscopy, the rotational speed of the rotation anode is switched from the low speed to a given medium speed. For X-ray photography, the rotational speed of the rotation anode is switched from the medium speed to a given high speed.

21 Claims, 5 Drawing Sheets

X-RAY CONTROL APPARATUS AND X-RAY DIAGNOSTIC APPARATUS

CROSS-REFERENCE TO RELATED APPLICATIONS

This application is based upon and claims the benefit of priority from the prior Japanese Patent Application No. 11-362885, filed Dec. 21, 1999, the entire contents of which are incorporated herein by reference.

BACKGROUND OF THE INVENTION

The present invention relates to an X-ray control apparatus for controlling an X-ray generator which irradiates a human body or other object under examination with X-rays as the result of a rotation anode in an X-ray tube being bombarded with a beam of electrons, and an X-ray diagnostic apparatus with the X-ray control apparatus.

The X-ray diagnostic apparatus is medical apparatus which provides fluoroscopy or X-ray photography. The X-ray diagnostic apparatus has an X-ray control apparatus, which controls an X-ray generator and is generally constructed as follows:

The X-ray control apparatus comprises a high-voltage generator and an X-ray tube which is supplied with a high output voltage of the high-voltage generator to generate X-rays. The X-ray tube has an anode that is supplied with the high voltage while being rotated at a given frequency (hereinafter referred to as the rotation anode). The reason why the anode is made rotatable is to protect it against burn due to electron beams.

The frequency at which the rotation anode is driven is switched, as required, between a low-speed frequency and a high-speed frequency in order to reduce abrasion of the bearing mechanism of the rotation anode. For instance, for higher X-ray output, the high-speed frequency is used, whereas, at the stage for preparation for X-ray photography, the low-speed frequency is used.

In general, the high voltage generator uses a commercial power frequency of 50 or 60 Hz. With 50 or 60 Hz as the low-speed frequency, the rotation anode will rotate at a low speed of 3000 or 3600 rpm. With 150 or 180 Hz three times higher than the low-speed frequency as the high-speed frequency, the rotation anode will rotate at a high speed of 9000 or 10800 rpm.

In recent years, an attempt has been made to increase the thermal capacity of the rotation anode in order to generate X-rays with more stability. An increase in the thermal capacity results in an increase in the weight of the rotation anode and consequently an increase in the time required to switch between the rotational speeds of the rotation anode.

FIG. 1 show examples of rotational characteristics of rotation anodes of X-ray tubes in conventional X-ray control apparatuses.

In FIG. 1, the curve A shows the rotational characteristic of the rotation anode of small thermal capacity (say, 140, 300 or 600 KHU) and the curve B shows the rotational characteristic of the rotation anode of large thermal capacity (say, 1500 KHU). The number of rotations (rpm) of the rotation anode is shown on the vertical axis and the time (seconds) that elapses from the time at which the rotation anode was switched from low speed to high speed is shown on the horizontal axis.

The delay involved in switching the rotational speed of the rotation anode resulting from its increased thermal capacity will be explained.

As can be seen from the curve A, in the case of the rotation anode of small capacity, the time interval that elapses from the stage of preparation for X-ray irradiation for X-ray photography at which the anode rotates at about 3000 rpm to the stage of execution of the X-ray irradiation at which the anode rotates at about 10000 rpm is one second or so. Thus, X-ray photography can be performed in a short period of time.

As can be seen from the curve B, on the other hand, in the case of the rotation anode of large capacity, the time interval is about three seconds. Thus, the time required for X-ray photography is increased, which may increase burden on an operator and patients.

To reduce abrasion of the bearing mechanism of the rotation anode, it is recommended that the time interval during which time the high-speed rotation is maintained be as short as possible.

BRIEF SUMMARY OF THE INVENTION

It is therefore an object of the present invention to provide an X-ray control apparatus and X-ray diagnostic apparatus which permit diagnosis to be made without extending the time of X-ray photography and consequently without imposing excess burden on the operator and patients even with a rotation anode of large thermal capacity.

According to an aspect of the present invention there is provided an X-ray control apparatus comprising: an X-ray tube having a rotation anode built in for irradiating an object under examination with X-rays; select means for selecting the rotational speed of the rotation anode of the X-ray tube from among a low speed, a medium speed, and a high speed; and drive means for driving the rotation anode into rotation at the rotational speed selected by the select means, and wherein, for X-ray irradiation by the X-ray tube, the select means selects either the medium speed or the high speed.

According to another aspect of the present invention there is provided an X-ray diagnostic apparatus comprising: an X-ray tube having a rotation anode built in for irradiating an object under examination with X-rays; select means for selecting the rotational speed of the rotation anode of the X-ray tube from among a low speed, a medium speed, and a high speed; and drive means for driving the rotation anode into rotation at the rotational speed selected by the select means, and wherein, for X-ray irradiation by the X-ray tube, the select means selects either the medium speed or the high speed.

According to still another aspect of the present invention there is provided an X-ray diagnostic apparatus comprising: an X-ray tube having a rotation anode built in for irradiating an object under examination with X-rays; select means for selecting the rotational speed of the rotation anode of the X-ray tube from a first speed and a second speed higher than the first speed; and drive means for driving the rotation anode into rotation at the rotational speed selected by the select means, and wherein, for X-ray irradiation by the X-ray tube, the select means selects the first speed for fluoroscopy and either the first speed or the second speed for X-ray photography.

With these configurations, an X-ray control apparatus and X-ray diagnostic apparatus which permit diagnosis to be made without extending the time of X-ray photography and consequently without imposing excess burden on the operator and patients even with a rotation anode of large thermal capacity can be realized.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
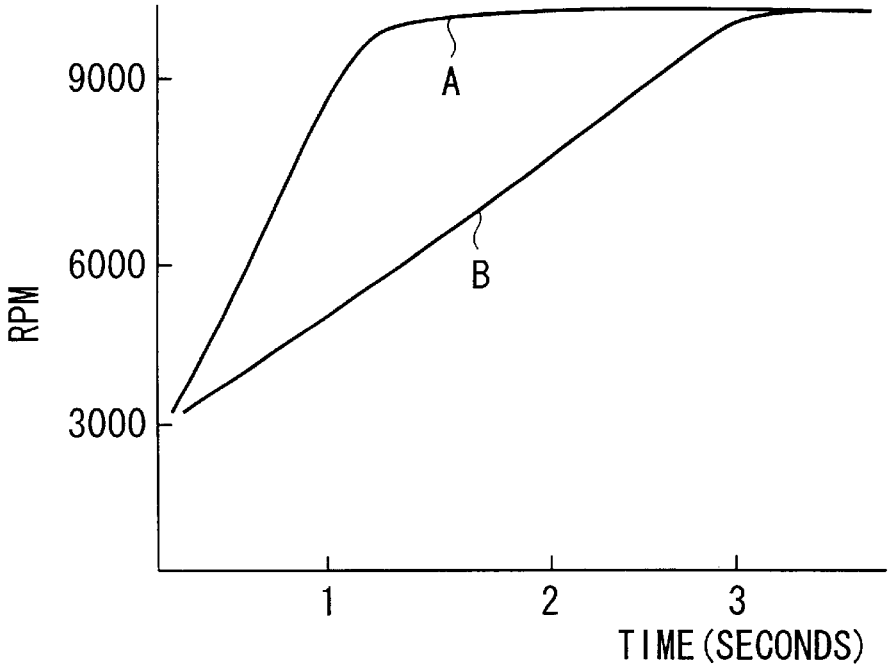
FIG. 1 PRIOR ART
FIG. 1 shows rotational characteristics of rotation anodes of X-ray tubes in conventional X-ray control apparatuses.

Hereinafter, first and second embodiments of the present invention will be described with reference to the accompanying drawings. In the following description, components having the same function and arrangement will be denoted by like reference numerals and repeated descriptions thereof are given only when necessary.

First Embodiment

First, the first embodiment will be described.

(1) X-ray control apparatus (1—1) High voltage generating unit

Figure 2:
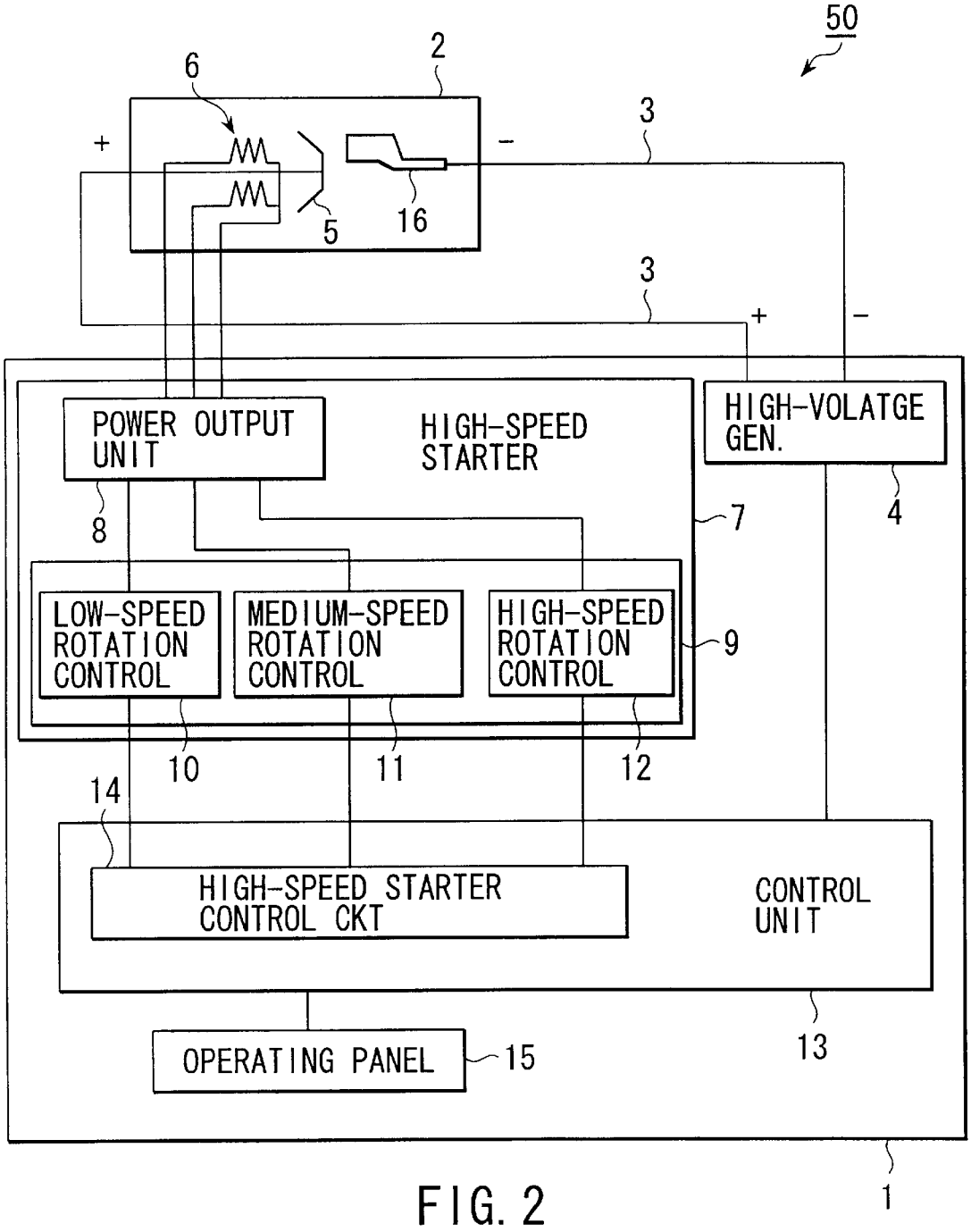
FIG. 2 is a schematic representation of an X-ray control apparatus of the invention.

FIG. 2 is a schematic representation of an X-ray control apparatus according to the first embodiment of the present invention. As shown, the X-ray control apparatus 50 comprises a high voltage generating unit 1, an X-ray tube 2, and high-voltage cables 3.

The high-voltage generating unit 1 comprises a high voltage generator 4, a high-speed starter 7, a control device 13, and an X-ray operating panel 15.

The high voltage generator 4 generates a high voltage to be applied to the X-ray tube 2.

The high-speed starter 7, which is a power supply for driving the rotation anode 5 to rotate, comprises a power output unit 8 for supplying driving power to stator coils 6 at a preset frequency and a rotation control unit 9 for controlling the frequency of the driving power from the power output unit 8 to change the number of rotations (rotational speed) of the rotation anode 5.

As the driving power frequency use is selectively made of one of preset frequencies which include a frequency in a range of 50 to 60 Hz which are commercial power frequencies (low-speed frequency), a frequency in a range of higher than 60 Hz to lower than 150 Hz (medium-speed frequency), and a frequency in a range of 150 to 180 Hz which are three times the commercial power frequencies (high-speed frequency).

The rotation control unit 9 in the high-speed starter 7 has a low-speed rotation control section 10, a medium-speed rotation control section 11, and a high-speed rotation control section 12. The low-speed rotation control section 10 performs control of rotation on the rotation anode 5 so that it rotates at a low speed corresponding to the low-speed frequency (in the range from 3000 to 3600 rpm). The medium-speed rotation control section 11 performs control of rotation on the rotation anode 5 so that it rotates at a medium speed corresponding to the medium-speed frequency (in the range from higher than 3600 to lower than 9000 rpm). The high-speed rotation control section 12 performs control of rotation on the rotation anode 5 so that it rotates at a high speed corresponding to the high-speed frequency (in the range from 9000 to 10800 rpm). Each of the low-speed rotation control section 10, the medium-speed rotation control section 11, and the high-speed rotation control section 12 is responsive to a start signal from the control unit 13 to drive the power output unit 8, thereby driving the stator coils 6 at a given frequency.

Thus, the rotation anode 5 is allowed to rotate at one of the low, medium and high rotational speeds which is selected by a control operation to be described later. The arrangement that allows the rotation anode to rotate at a selected one of three preset speeds is one of features of the X-ray control apparatus and the X-ray diagnostic apparatus of the present invention.

The control unit 13 controls the operation of the high voltage generator 4 and the high-speed starter 7. The control unit 13 has a high-speed starter control circuit 14 for controlling the operation of the high-speed starter 7, which makes a selection from the three driving frequencies for the rotation anode 5 on the basis of X-ray output conditions or X-ray irradiation conditions entered by the operator through the operating panel 15 and then outputs a signal indicative of the selected driving frequency to the rotation control unit 9 in the high-speed starter 7.

The control unit 13 performs control to allow the standby state of the rotation anode 5 in rotation at the low or medium speed to last for a predetermined period of time. This control operation will be described later.

The operating panel 15 is input means for allowing the operator to enter X-ray output conditions (tube current, tube voltage, time) and X-ray irradiation conditions (information concerning fluoroscopy/X-ray photography).

(1–2) X-ray tube

The X-ray tube 2 has a cathode 16, the rotation anode 5, and the stator coils 6.

The stator coils 6 are electrically connected to the high-speed starter 7 and, when driven, rotates the rotation anode 5.

The cathode 16 consists of a tungsten filament that emits thermions when supplied with voltage and a focusing electrode that forms a focus at which the electrons converge.

The rotation anode 5 is formed to have a large thermal capacity of 1 MHU (mega heat unit) or more. When bombarded with electrons from the cathode 16, the rotation anode emits X-rays. The rotation of the anode 5 allows the point on which electrons impinge to disperse, thereby protecting the anode against heat melting of the surface.

The rotation anode of large thermal capacity refers to one having a thermal capacity of 1 MHU or more, say, 1500 KHU. On the other hand, the rotation anode of small thermal capacity refers to one having a thermal capacity of less than 1 MHU, say, 140, 300, or 600 KHU. Note that 1 HU=0.71 J. Thus, 1 MHU=0.71 MJ.

Figure 3:
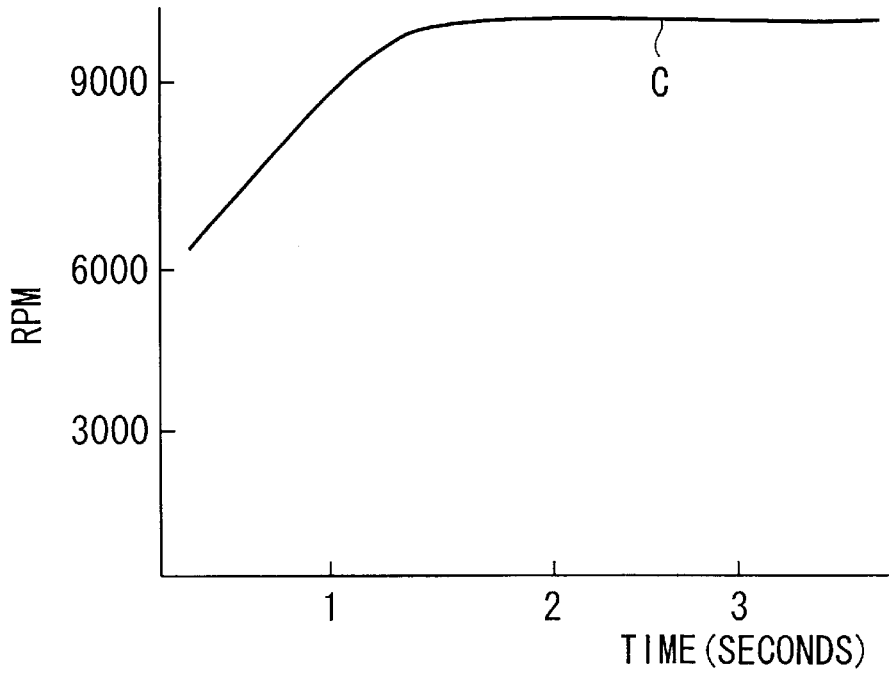
FIG. 3 shows an example of the rotational characteristic of the rotation anode of the X-ray tube in the X-ray control apparatus of FIG. 2.

The rotational speed of the rotation anode 5 is controlled by the rotation control unit 9. By the control, the rotation anode 5 is allowed to have the following rotation characteristic:

FIG. 3 shows the rotation characteristic of the rotation anode 5 of the X-ray tube 5. In this figure, the number of rotations (rpm) of the rotation anode is shown on the vertical axis and the time (seconds) which elapses from the switching from low rotational speed to high rotational speed is shown on the horizontal axis.

As can be seen from FIG. 3, according to the X-ray control apparatus of the present invention, the rotation anode 5 can be switched from medium rotational speed (about 6000 rpm) to high rotational speed (about 9000 rpm) in about one second. As will be described later, therefore, by allowing the rotation anode to stand by while rotating at medium speed in the stage for preparation for X-ray photography, a high rotational speed required for X-ray photography can be reached in about one second. Therefore, even with a rotation anode of large thermal capacity, X-ray photography can be carried out in as little as one second as with a rotation anode of small capacity.

(2) X-ray diagnostic apparatus

An X-ray diagnostic apparatus of the present invention will be described next with reference to FIG. 4, which is a block diagram of the X-ray diagnostic apparatus.

Figure 4:
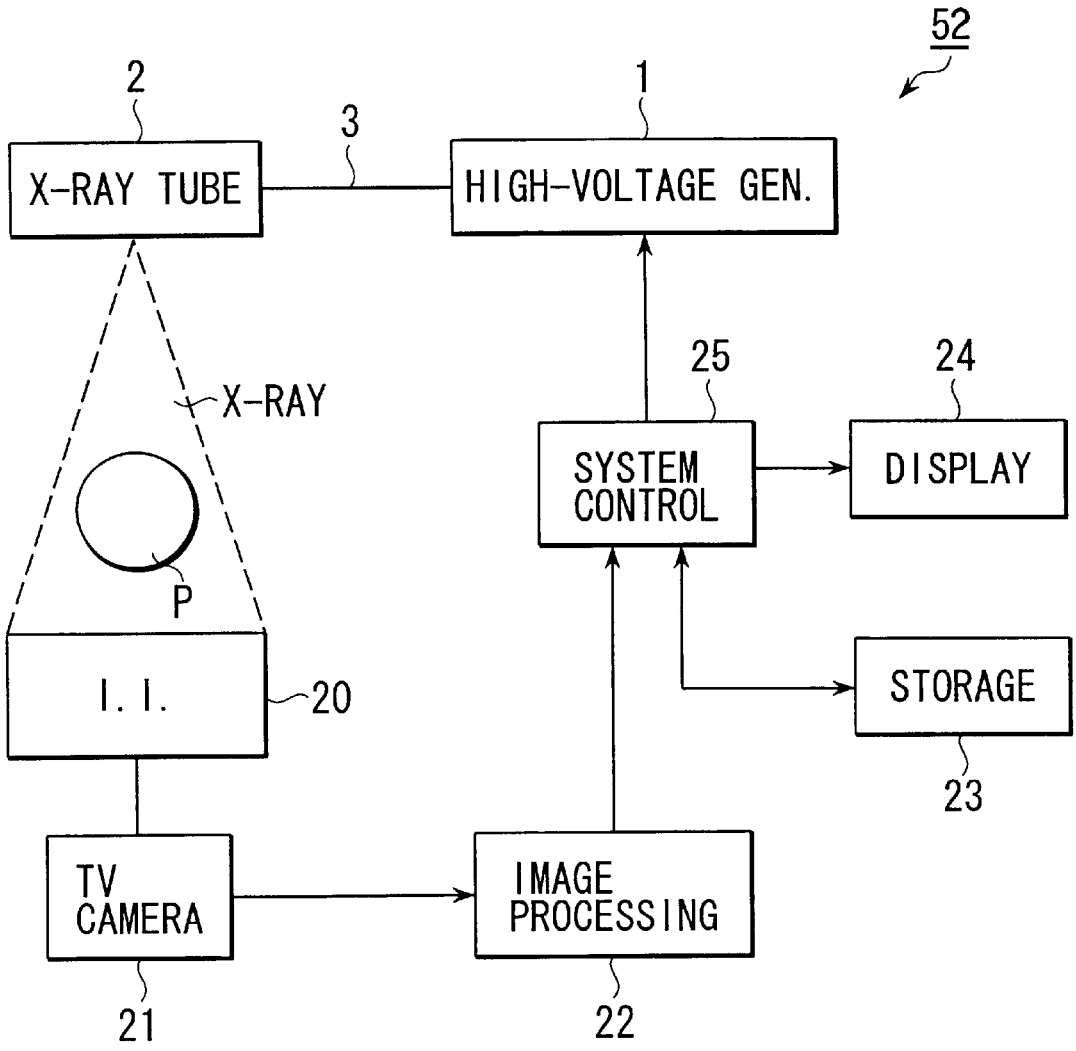
FIG. 4 is a schematic representation of a first embodiment of an X-ray diagnostic apparatus of the present invention.

As shown in FIG. 4, the X-ray diagnostic apparatus comprises the aforementioned high voltage generator 1, the X-ray tube 2, an image intensifier (I.I.) 20, a TV camera 21, an image processing unit 22, a storage unit 23, a display unit 24, and a system control unit 25. The repeated descriptions of the high voltage generator 1, the X-ray tube 2 and the cables 3 are omitted here.

The image intensifier 20 is detecting means for converting X-rays emitted from the X-ray tube 2 and passed through a human body P under examination into an optical image. The image intensifier is placed opposite to the X-ray tube 2 with the human body P interposed therebetween.

The TV camera 21 converts the optical image produced by the image intensifier 20 into an electrical signal.

The image processing unit 22 performs image processing on the electrical signal obtained from the TV camera to produce an X-ray image.

The storage unit 23 stores the X-ray image produced by the image processing unit 22.

The display unit 24 displays the X-ray image produced by the image processing unit 22.

The system control unit 25 controls the overall operation of the X-ray diagnostic apparatus.

The X-ray diagnostic apparatus thus configured can provide fluoroscopy in which a human body is subjected continuously to a small dosage of X-rays to obtain X-ray moving images and X-ray photography in which the human body is subjected, at each shot, to a larger dosage of X-rays than in the fluoroscopy to obtain an X-ray still image.

(3) High-voltage cables

The cables 3 electrically connect the high voltage generator 1 and the X-ray tube 2.

(Operation)

Next, the photographic operation of the X-ray diagnostic apparatus equipped with the X-ray control apparatus will be described particularly in terms of the control of the rotational speed of the rotation anode.

The significant point of the control of the rotational speed of the rotation anode according to the X-ray control apparatus and the X-ray diagnostic apparatus of the present invention lies in the idea of speeding up the transition to fluoroscopy or X-ray photography by setting new rotational speeds used at X-ray irradiation and standby times.

Specifically, the rotation anode 5 is set to rotate at three speeds: a high, a medium, and a low one. The high rotational speed is used for X-ray photography in which a large dosage of X-rays is emitted at each shot. The low rotational speed is used when no X-ray irradiation is made. The medium rotational speed is used for fluoroscopy in which a relatively small dosage of X-rays is emitted continuously.

(Examples)

There is illustrated an example of rotation control of the rotation anode 5 based on the three rotational speeds.

Figure 5:
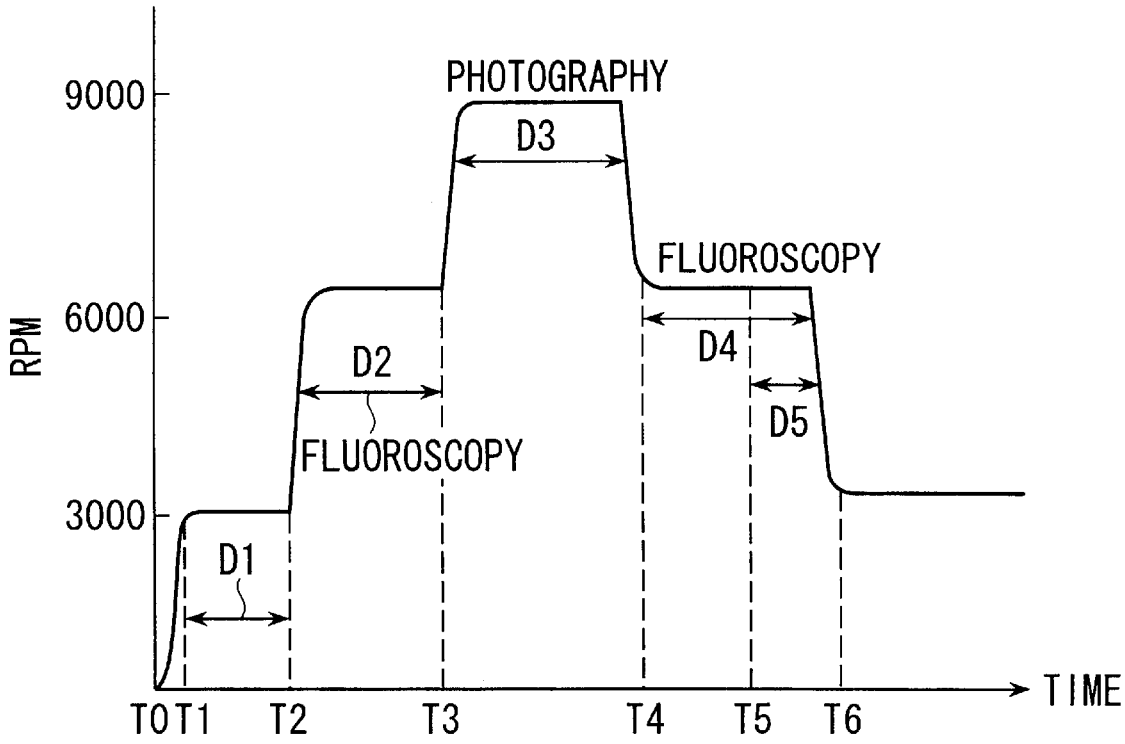
FIG. 5 shows variations in the rotational speed of the rotation anode at the times of fluoroscopy and X-ray photography in the first embodiment of the X-ray diagnostic apparatus.

FIG. 5 shows variations in the number of rotations of the rotation anode at the times of fluoroscopy and X-ray photography by the X-ray diagnostic apparatus having the X-ray control apparatus. The number of rotations is shown on the vertical axis and the elapsed time in X-ray photography including fluoroscopy is shown on the horizontal axis.

Figure 6:
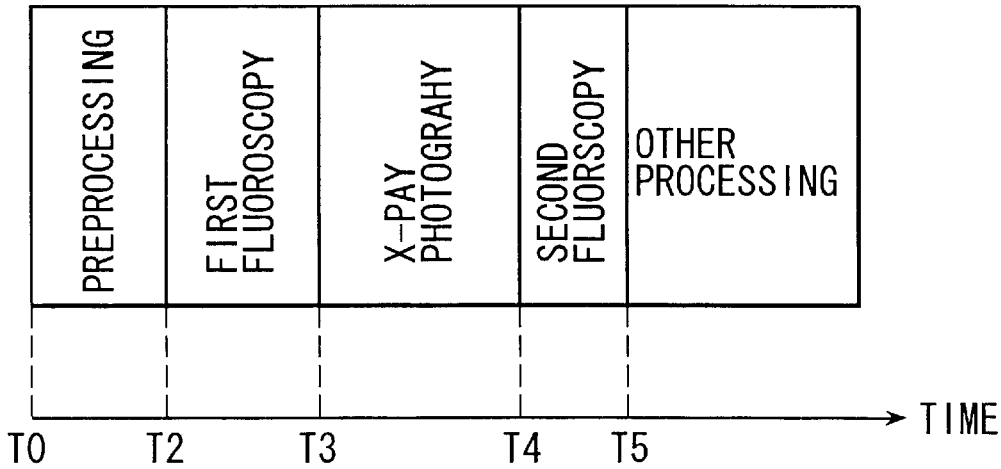
FIG. 6 shows the flow of a photographic operation performed by the first embodiment of the X-ray diagnostic apparatus.

FIG. 6 shows the flow of an photographic operation performed by the X-ray diagnostic apparatus.

The switching of the rotational speed of the rotation anode at the times of fluoroscopy, X-ray photography and standby in the photographic operation shown in FIG. 6 will be described with reference to FIG. 5.

First, the power to the apparatus is turned on (time T0 in FIG. 5).

At the same time the power is turned on, the high-speed starter control circuit 14 in the control unit 13 selects and drives the low-speed rotation control section 10 in order to allow quick X-ray irradiations for fluoroscopy. The power output unit 8 thereby supplies the stator coils 6 with power at the preset low-speed frequency. The rotation anode 5 is responsive to the power supply to begin rotating at a low speed (for example, 3000 rpm) (time T1 in FIG. 5). The rotation anode is placed in the standby state while rotating at the low speed (interval D1 in FIG. 5).

Next, as shown in FIG. 6, fluoroscopy is carried out to identify an imaging body region prior to X-ray irradiation to the human body P for subsequent X-ray photography. Specifically, when predetermined input operations are performed on the operating panel 15, the high-speed starter control circuit 14 selects and drives the medium-speed rotation control section 11 accordingly. Thereby, the power output unit 8 supplies the stator coils 6 with power at the medium-speed frequency with the result that the rotation anode begins rotating at the medium speed (for example, 6000 rpm) (time T2 in FIG. 5).

The operator, such as a doctor, watches an X-ray image displayed on the display unit 24 to identify the imaging region of the human body P by fluoroscopy (first fluoroscopy in FIG. 6). The rotation anode 5 is kept to rotate at the medium speed during the interval of fluoroscopy (interval D2 in FIG. 5).

Subsequently, X-ray photography is carried out as shown in FIG. 6. Specifically, when an X-ray irradiation button (not shown) on the operating panel 15 is pressed by the operator, the high-speed starter control circuit 14 selects and drives the high-speed rotation control section 12. Thereby, the power output unit 8 supplies the stator coils 6 with power at the preset high-speed frequency with the result that the rotation anode begins rotating at the high speed (for example, 9000 rpm) (time T3 in FIG. 5).

After the preset high speed has been reached, X-ray irradiation for X-ray photography is performed. The rotation anode is kept to rotate at the high speed during the X-ray photography (interval D3).

The interval that elapses from the depression of the X-ray irradiation button to the time when the rotation anode has come to rotate at the high speed is about one second as described previously in connection with FIG. 3. Therefore, the X-ray diagnostic apparatus of the invention is allowed to make the transition from fluoroscopy to X-ray photography in a short period of time even with the rotation anode of large thermal capacity. As a result, diagnosis can be made without extending the time of X-ray photography and consequently without imposing excess burden on the operator and patients.

At the termination of the X-ray photography, the rotational speed of the rotation anode is switched from high to medium (time T4 in FIG. 5). That is, the high-speed starter control circuit 14 drives the medium-speed rotation control section 11 to thereby allow the power output unit 8 to supply the stator coils 6 with power at the medium-speed frequency. The rotation anode 5 then begins rotating at the medium speed (time T4 in FIG. 5).

After that, the second fluoroscopy is carried out as shown in FIG. 6.

When the second fluoroscopy terminates at time T5 in FIG. 5, the rotation anode 5 is placed in the standby state while keeping rotating at the medium speed. The standby state lasts for a predetermined interval of time from the termination of the second fluoroscopy (interval D in FIG. 5). When no fluoroscopy is performed even if the predetermined interval of time has elapsed, the standby state terminates (time T6 in FIG. 5).

When fluoroscopy is performed again in the standby state, a quick transition can be made to the fluoroscopy process because the rotation anode 5 is rotating at the medium speed.

To repeat the fluoroscopy and the X-ray photography, the above speed control of the rotation anode is simply repeated. Thereby, the rotation anode always makes the transition from the medium-speed rotation to the high-speed rotation. In X-ray photography, therefore, the setup time can always be reduced.

The interval during which time the standby state in which the rotation anode is rotating at the medium speed is maintained may be set arbitrarily by the operator through the operating panel 15.

At the termination of the standby state, the high-speed starter control circuit 14 selects and drives the low-speed rotation control section 10 at time T6. As a result, the power output unit 8 supplies the stator coils 6 with power at the low-speed frequency under the control of the low-speed rotation control section 10, thus allowing the rotation anode 5 to begin rotating at the low speed (time T6 in FIG. 5).

(Provisions for inherent vibration)

Next, provisions for the inherent vibration of the X-ray tube 2 in the rotation control of the rotation anode 5 will be described.

The number of rotations based on the inherent vibration (corresponding to the resonant frequency) of the X-ray tube assembly generally exists in the range from 4000 to 6000 rpm. For the above rotation control of the rotation anode, the number of rotations at the medium speed is defined to be larger than the number of rotations based on the inherent vibration. According to the X-ray control apparatus, therefore, the number of rotations of the rotation anode only passes through the number of rotations based on inherent vibration at the rotational speed switching time. As a result, bad effects due to the inherent vibration can be minimized. Particularly, if the number of rotations of the rotation anode at the medium speed is set to fall within the range from 6000 to 9000 rpm, then the rotation anode will not have to pass through the inherent vibration-based number of rotations of the X-ray tube at the time of switching from the medium speed to the high speed. Thus, the number of occurrences of mechanical vibration due to the inherent vibration of the X-ray tube can be reduced, increasing the lifetime and reliability of the X-ray tube.

The above-described example is configured such that the rotation anode is rotated at the medium speed when fluoroscopy is carried out or to provide for quick transition to X-ray photography. Also, when X-ray irradiation is not performed for a predetermined interval of time, or when certain conditions are satisfied, the rotation anode is rotated at the medium speed. In addition, when X-ray photography is performed, the rotation anode is rotated at the high speed. When there is no need to provide for X-ray irradiation quickly, the rotation anode is rotated at the low speed.

Such a configuration allows diagnosis to be made without extending the time of X-ray photography and hence without imposing excess burden on the operator and patients.

The use of the high-speed rotation of the rotation anode is limited to X-ray photography only and is therefore minimized. As a result, the life of the X-ray tube can be increased compared with the case where the high-speed rotation is used frequently.

(Second Embodiment)

An X-ray control apparatus and an X-ray diagnostic apparatus according to a second embodiment will be described next.

The first embodiment is configured such that the rotational speed of the rotation anode is switched among the low, the medium and the high speed and the rotation anode is rotated at one of the speeds selected as required. In contrast, the second embodiment is configured such that the rotational speed of the rotation anode is switched between only two speeds: a medium speed and a high speed. That is, no low-speed rotation is used.

(1) X-ray control apparatus

The X-ray control apparatus is identical in configuration to the one of FIG. 2 according to the first embodiment except that the low-speed rotation control section 10 is omitted because, in the second embodiment, a medium and a high rotational speed are set as the rotational speed of the rotation anode.

In the second embodiment, the high and medium rotational speeds of the rotation anode are set at, say, about 8000 and 6000 rpm, respectively. Each rotational speed is set through a given input from the operating panel 5. The control unit 13 is responsive to the input to select and drive either the medium-speed rotation control section 10 or the high-speed rotation control section 12.

(2) X-ray diagnostic apparatus

The X-ray diagnostic apparatus remains unchanged from the one according to the first embodiment and a description thereof is therefore omitted.

(3) High-voltage cables

The cables remain unchanged from those in the first embodiment and a description thereof is therefore omitted.

EXAMPLES

A photographic operation of the X-ray diagnostic apparatus having the X-ray control apparatus according to the second embodiment will be described next with emphasis put on control of the rotational speed of the rotation anode. The following control of the rotational speed is particularly useful for rotation anodes having a bearing mechanism that is capable of withstanding rotation at speeds of the medium speed and above, such as a bearing mechanism employed liquid metal.

Figure 7:
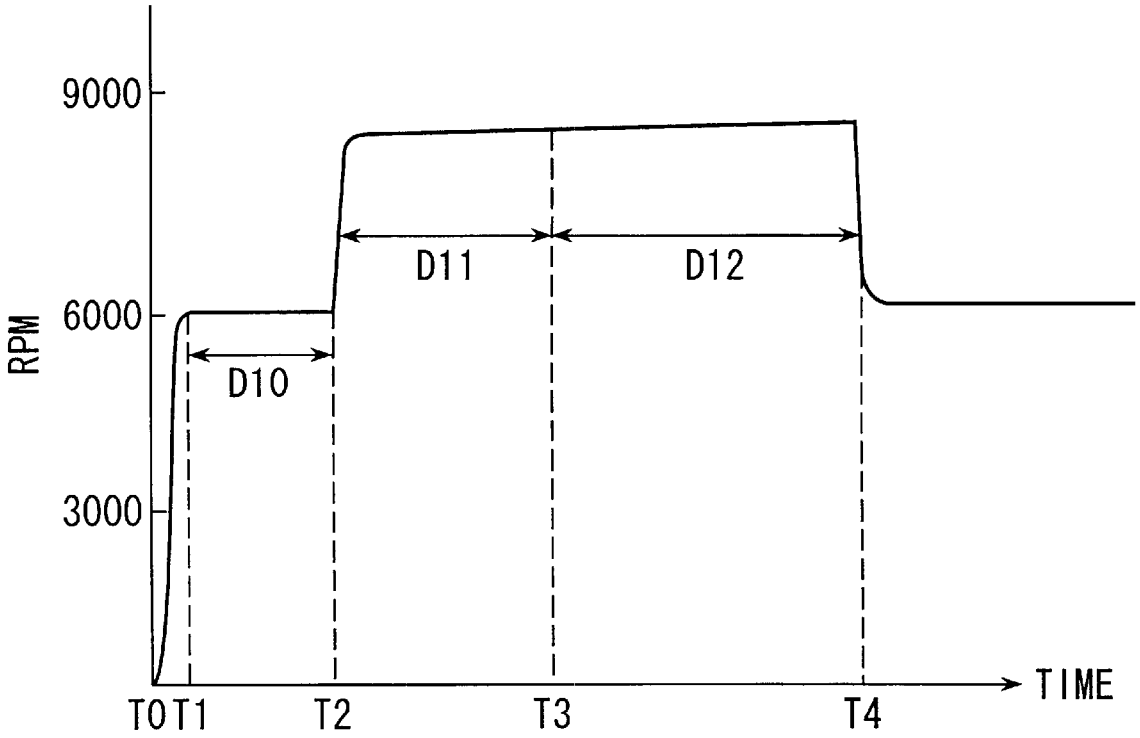
FIG. 7 shows variations in the rotational speed of the rotation anode at the times of fluoroscopy and X-ray photography in a second embodiment of the X-ray diagnostic apparatus.

FIG. 7 shows variations in the number of rotations of the rotation anode at the times of fluoroscopy and X-ray photography by the X-ray diagnostic apparatus of the second embodiment. The number of rotations is shown on the vertical axis and the elapsed time in photography including fluoroscopy is shown on the horizontal axis.

Figure 8:
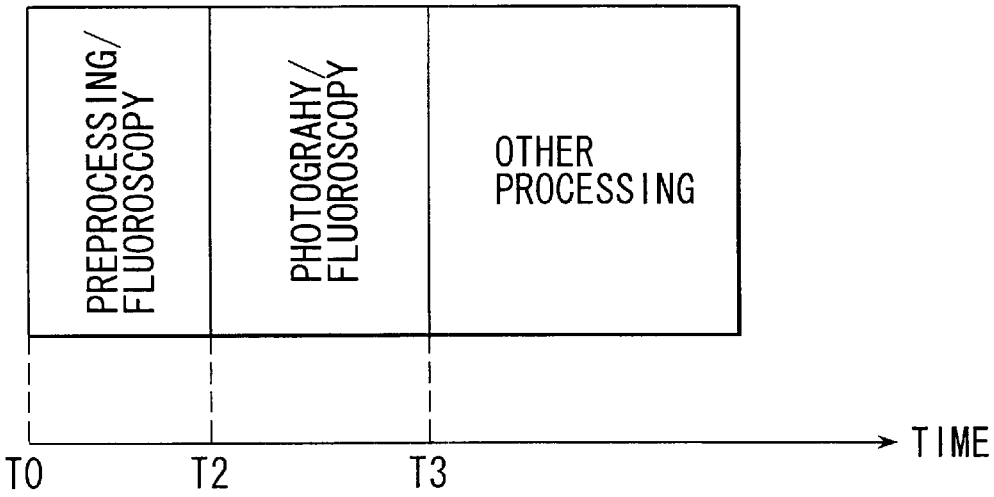
FIG. 8 shows the flow of a photographic operation performed by the second embodiment of the X-ray diagnostic apparatus.

FIG. 8 shows the flow of an photographic operation performed by the X-ray diagnostic apparatus.

The switching of the rotational speed of the rotation anode at the times of fluoroscopy, X-ray photography and standby in the photographic operation shown in FIG. 8 will be described with reference to FIG. 7.

First, the power is applied to the apparatus (time T0 in FIG. 7).

At the same time the power is turned on, the high-speed starter control circuit 14 in the control unit 13 selects and drives the medium-speed rotation control section 11 in order to allow quick X-ray irradiation for fluoroscopy. The power output unit 8 thereby supplies the stator coils 6 with power at the preset medium-speed frequency. The rotation anode 5 is responsive to the power supply to begin rotating at a medium speed (for example, 6000 rpm) (time T1 in FIG. 7). The rotation anode is placed in the standby state while rotating at the medium speed.

Next, as shown in FIG. 8, fluoroscopy is carried out to identify an imaging body region prior to X-ray irradiation to the human body P for subsequent X-ray photography. The operator, such as a doctor, watches an X-ray image displayed on the display unit 24 to identify the imaging region of the human body P by fluoroscopy (first fluoroscopy in FIG. 6). The rotation anode 5 is kept to rotate at the medium speed throughout the fluoroscopy (interval D10).

Subsequently, X-ray photography is carried out as shown in FIG. 8. The rotation control at this time is the same as in the first embodiment. That is, in response to a given operation by the operator, the high-speed starter control circuit 14 selects and drives the high-speed rotation control section 12. Thereby, the power output unit 8 supplies the stator coils 6 with power at the preset high-speed frequency with the result that the rotation anode begins rotating at the high speed (for example, 8000 rpm) (time T2 in FIG. 7).

The interval that elapses from the depression of the X-ray irradiation button to the time when the rotation anode has come to rotate at the high speed is about one second as with the first embodiment. Therefore, the X-ray diagnostic apparatus can make the transition from fluoroscopy to X-ray photography in a short interval of time even with the rotation anode of large thermal capacity. As a result, diagnosis can be made without extending the time of X-ray photography and consequently without imposing excess burden on the operator and patients.

Subsequently, fluoroscopy or X-ray photography is carried out as required. When X-ray photography or fluoroscopy after X-ray photography is carried out, the rotational speed of the rotation anode is maintained at the high speed throughout the X-ray photography (interval D11 in FIG. 7).

When the fluoroscopy or X-ray photography terminates at time T3 in FIG. 7, the rotation anode 5 is placed in the standby state while keeping rotating at the high speed. The standby state lasts for a predetermined period of time from the time T3 (interval D12 in FIG. 7). When no fluoroscopy is performed again if the predetermined interval of time has elapsed, the standby state terminates (time T4 in FIG. 7).

This rotation control is a feature of the second embodiment. That is, the first embodiment is arranged such that, after the X-ray photography, the rotation anode is placed in the standby state while keeping rotating at the medium speed. In contrast, the second embodiment is arranged such that the rotation anode is placed in the standby state while keeping rotating at the high speed.

When fluoroscopy or X-ray photography is carried out again in the standby state, a quick transition can be made to the fluoroscopy process because the rotation anode 5 is rotating at the high speed. Particularly, when X-ray photography is carried out again, the transition to it can be made more quickly than in the first embodiment because the rotation anode keeps the high rotational speed in the standby state.

At the termination of the standby state, the high-speed starter control circuit 14 selects and drives the medium-speed rotation control section 10 at time T4. As a result, the power output unit 8 supplies the stator coils 6 with power at the medium-speed frequency under the control of the medium-speed rotation control section 10, thus allowing the rotation anode 5 to begin rotating at the medium speed. After time T4, the rotation anode 5 is placed in the standby state while keeping the medium rotational speed.

To carry out X-ray photography after time T4, the above speed control of the rotation anode is simply repeated. Thereby, the rotation anode is allowed to make the transition from the medium-speed rotation to the high-speed rotation. When fluoroscopy is performed again in the standby state after time T4, a quick transition can be made to the fluoroscopy process because the rotation anode is rotating at the medium speed.

(Provisions for inherent vibration)

As in the first embodiment, the number of rotations of the rotation anode only passes through the number of rotations based on inherent vibration at the rotational speed switching time. As a result, bad effects due to the inherent vibration can be minimized.

In the second embodiment, the medium and high rotational speeds of the rotation anode are set to about 6000 and 8000 rpm, respectively. Therefore, the number of rotations of the rotation anode will not pass through the inherent vibration-based number of rotations of the X-ray tube at the time of switching from the medium speed to the high speed. Thus, the number of occurrences of mechanical vibration due to the inherent vibration of the X-ray tube can be reduced, increasing the lifetime and reliability of the X-ray tube.

According to the above configuration, when use is made of an X-ray tube equipped with a rotation anode of large thermal capacity, the rotational speed of the rotation anode is kept at a medium speed in the standby state before X-ray irradiation and at the time of fluoroscopy before X-ray photography. For X-ray photography, the rotational speed of the rotation anode is switched from the medium speed to a high speed. The rotation anode is kept to rotate at the high speed for a predetermined period of time from the start of the first-time X-ray photography, allowing quick X-ray photography and fluoroscopy. When no X-ray photography or fluoroscopy is carried out for a while, the rotational speed of the rotation anode is returned again to the medium speed.

Accordingly, diagnosis can be made without extending the time of X-ray photography and consequently without imposing excess burden on the operator and patients even with a rotation anode of large thermal capacity.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An X-ray control apparatus comprising:

an X-ray tube having a rotation anode built in for irradiating an object under examination with X-rays;

select means for selecting the rotational speed of said rotation anode of said X-ray tube from among a low speed, a medium speed, and a high speed; and drive means for driving said rotation anode into rotation at the rotational speed selected by said select means, and wherein, for X-ray irradiation by said X-ray tube, said select means selects either the medium speed or the high speed.

2. The X-ray control apparatus according to claim 1, wherein, when no X-ray irradiation is made by said X-ray tube, said select means selects either the low speed or the medium speed.

3. The X-ray control apparatus according to claim 1, wherein the thermal capacity of said rotation anode of said X-ray tube is 1 MHU or more.

4. The X-ray control apparatus according to claim 1, wherein the low speed, the medium speed and the high speed at which said rotation anode rotates lie in a range of a rotational speed corresponding to a commercial power frequency to a rotational speed corresponding to three times the commercial power frequency.

5. The X-ray control apparatus according to claim 4, wherein the medium speed is higher than a rotational speed corresponding to the resonant frequency of said X-ray tube.

6. The X-ray control apparatus according to claim 1, wherein the low speed is in a range of 3000 to 3600 rpm, the medium speed is in a range of 3600 to 9000 rpm, and the high speed is in a range of 9000 to 10800 rpm.

7. The X-ray control apparatus according to claim 1, wherein, when no X-ray irradiation is made by said X-ray tube, said select means selects either the low speed or the medium speed.

8. The X-ray control apparatus according to claim 1, wherein, when no X-ray irradiation is made by said X-ray tube for a predetermined period of time, said select means selects the low speed.

9. An X-ray diagnostic apparatus comprising:

an X-ray tube having a rotation anode built in for irradiating an object under examination with X-rays;

select means for selecting the rotational speed of the rotation anode of said X-ray tube from among a low speed, a medium speed, and a high speed; and drive means for driving said rotation anode into rotation at the rotational speed selected by said select means, and wherein, for X-ray irradiation by said X-ray tube, said select means selects either the medium speed or the high speed.

10. The X-ray diagnostic apparatus according to claim 9, wherein, when no X-ray irradiation is made by said X-ray tube, said select means selects either the low speed or the medium speed.

11. The X-ray diagnostic apparatus according to claim 9, wherein the thermal capacity of the rotation anode of said X-ray tube is 1 MHU or more.

12. The X-ray diagnostic apparatus according to claim 9, wherein the low speed, the medium speed and the high speed at which said rotation anode rotates lie in a range of a rotational speed corresponding to a commercial power frequency to a rotational speed corresponding to three times the commercial power frequency.

13. The X-ray diagnostic apparatus according to claim 9, wherein the medium speed is higher than a rotational speed corresponding to the resonant frequency of said X-ray tube.

14. The X-ray diagnostic apparatus according to claim 9, wherein the low speed is in a range of 3000 to 3600 rpm, the medium speed is in a range of 3600 to 9000 rpm, and the high speed is in a range of 9000 to 10800 rpm.

15. The X-ray diagnostic apparatus according to claim 9, wherein, when no X-ray irradiation is made by said X-ray tube, said select means selects either the low speed or the medium speed.

16. The X-ray diagnostic apparatus according to claim 1, wherein, when no X-ray irradiation is made by said X-ray tube for a predetermined period of time, said select means selects the low speed.

17. An X-ray diagnostic apparatus comprising:

an X-ray tube having a rotation anode built in for irradiating an object under examination with X-rays;

select means for selecting the rotational speed of said rotation anode of said X-ray tube from a first speed and a second speed higher than the first speed; and drive means for driving said rotation anode into rotation at the rotational speed selected by said select means, and wherein, for X-ray irradiation by said X-ray tube, said select means selects the first speed for fluoroscopy and either the first speed or the second speed for X-ray photography.

18. The X-ray diagnostic apparatus according to claim 17, wherein, when no X-ray irradiation is made by said X-ray tube, said select means selects the first speed.

19. The X-ray diagnostic apparatus according to claim 17, wherein, when no X-ray irradiation is made by said X-ray tube for a predetermined period of time, said select means selects the first speed.

20. The X-ray diagnostic apparatus according to claim 17, wherein the first speed is in a range of 6000 to 9000 rpm and the second speed is in a range of 9000 to 10800 rpm.

21. The X-ray diagnostic apparatus according to claim 17, wherein the first speed is higher than a rotational speed corresponding to the resonant frequency of said X-ray tube.

* * * * *